US007009329B2

(12) United States Patent
Haas et al.

(10) Patent No.: US 7,009,329 B2
(45) Date of Patent: Mar. 7, 2006

(54) THERMALLY OPTIMIZED COLD CATHODE HEATER

(75) Inventors: William R. Haas, Fort Collins, CO (US); Kirk S. Tecu, Greely, CO (US); Louis R. Turf, III, Loveland, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 195 days.

(21) Appl. No.: 10/644,722

(22) Filed: Aug. 20, 2003

(65) Prior Publication Data

US 2005/0040748 A1 Feb. 24, 2005

(51) Int. Cl.
*H01J 7/24* (2006.01)
*H01J 1/02* (2006.01)

(52) U.S. Cl. ..... 313/44; 313/591; 313/14; 313/15; 315/112; 315/115; 315/118

(58) Field of Classification Search ..... 313/11, 313/39, 44, 591–593, 15; 315/112–118
See application file for complete search history.

(56) References Cited

U.S. PATENT DOCUMENTS 3,323,010 A * 5/1967 Bisjak et al. ..... 313/567
4,137,483 A * 1/1979 Ochi et al. ..... 315/74
4,256,991 A 3/1981 Otala
4,355,259 A 10/1982 Weiss
4,520,290 A 5/1985 Cokefair
4,889,009 A * 12/1989 Friedmann et al. ..... 74/574
4,969,849 A 11/1990 Smith et al.
5,047,689 A 9/1991 Kawai et al.
5,436,431 A 7/1995 Tsuji et al.
5,907,742 A 5/1999 Johnson et al.
6,294,883 B1 9/2001 Weindorf

FOREIGN PATENT DOCUMENTS

DE 2741693 A * 3/1978
JP 59171450 A * 9/1984
JP 10064685 A * 3/1998

OTHER PUBLICATIONS

Photograph showing a cold cathode lamp disposed in a scanner carriage assemble, p. 1 of 1.

* cited by examiner

*Primary Examiner*—Mariceli Santiago

(57) ABSTRACT

Systems and methods for providing a thermally optimized cold cathode heater in which a heater wire is disposed in a plurality of turns are shown. Turns of the plurality of turns are closely spaced to concentrate heat in an area of a host cathode device corresponding to a cold cathode position and turns of the plurality of turns are disposed to minimize introduction of heat in an area of the host cathode device not corresponding to the cold cathode position.

16 Claims, 2 Drawing Sheets

THERMALLY OPTIMIZED COLD CATHODE HEATER

FIELD OF THE INVENTION

The invention relates generally to devices utilizing cathodes, more particularly, to thermally optimized cold cathode heaters.

DESCRIPTION OF RELATED ART

Devices utilizing cathode emissions are employed in a number of electronic devices today. For example, optical scanners typically use cold cathode lamps for providing a light source to illuminate media and other objects being imaged. Although cold cathodes used in such cold cathode lamps provide field emission of electrons at ambient temperatures, field emission sufficient to provide a desired light intensity often relies upon the cathode being heated above ambient temperatures. In a typical configuration, it takes between 30 and 60 seconds for a cold cathode lamp in an optical scanner to warm-up sufficiently to provide a desired level of illumination for optical scanning.

A common technique for providing warm-up of a device utilizing cathode emissions is to delay operation a sufficient period of time to allow energizing of the cathode to heat the cathode to a suitable temperature. For example, an optical scanner may be programmed to delay the beginning of the first scan for 30 to 60 seconds. However, this technique often results in user dissatisfaction due to operational delays. To minimize wait times, the scanner may be further programmed to leave the lamp on for some period of time following a scan, e.g., for a period of minutes or hours, to avoid the aforementioned warm-up period between scans. However, this technique results in increased power consumption and may further be associated with premature failure of the lamp.

A technique implemented to minimize warm-up time with respect to cold cathode lamps has been to uniformly wind a heater wire around the exterior of the lamp. This heater wire may be energized to provide heating of the lamp and, thus, the cold cathodes. Accordingly, when the lamp is energized the cold cathodes are warned, at least to an extent, thereby minimizing lamp warm-up time. Although often viewed as an improvement over the aforementioned warm-up period, the use of such a heater wire is not without disadvantage. For example, such as a lamp heater wire may consume energy when the lamp (and the scanner) is not in use. Moreover, the heater wire produces heat which can be objectionable to some users and in some situations.

Other device configurations are possible to address and/or overcome the aforementioned device warm-up time. For example, hot cathode device configurations may be utilized. However, hot cathode lamps are more costly and larger than cold cathode lamps providing similar illumination, and therefore such hot cathode lamp configurations are often not well suited for modem scanner or other electronic device implementations.

SUMMARY

A system for providing a thermally optimized cold cathode heater, the system comprising, a heater wire disposed in a plurality of turns, wherein turns of the plurality of turns are closely spaced to concentrate heat in an area of a host cathode device corresponding to a cold cathode position, and wherein turns of the plurality of turns are disposed to minimize introduction of heat in an area of the host cathode device not corresponding to the cold cathode position.

A system comprising a cold cathode heater having a heater wire disposed in a plurality of turns, wherein turns of the plurality of turns are more closely spaced in a portion of the cold cathode heater corresponding to a cold cathode position and less closely spaced in a portion of the cold cathode heater that does not correspond to the cold cathode position.

A method for providing heat to a cold cathode, the method comprising, wrapping a device having the cold cathode with a heater wire, varying spacing of the heater wire around the device to concentrate heat in an area of the device corresponding to the cold cathode and to minimize heat in an area of the device not corresponding to the code cathode, and coupling the heater wire to a controller.

DETAILED DESCRIPTION

Cathode emission devices, such as cold cathode fluorescent lamps (CCFL), are employed in a number of electronic devices today. Although embodiments are described herein with reference to CCFLs employed with respect to optical scanners, such as to provide a light source to illuminate media and other objects being imaged, the concepts of the present invention are nether limited to use with respect to CCFLs nor optical scanners. For example, embodiments of the present invention may be utilized with respect to facsimile machines, photocopiers, liquid crystal display (LCD) back lights, or other devices.

Embodiments of the present invention provide cathode heater configurations which concentrate heat at the cathodes to thereby optimize the effectiveness of the heater as well as to minimize energy consumption associated with the use of the heater and minimize production of excess heat. For example, when used with respect to a cold cathode lamp such as CCFL 10, embodiments of the present invention provide a heater wire configuration which concentrates the heat on the ends of the cold cathode lamp.

Figure 1:
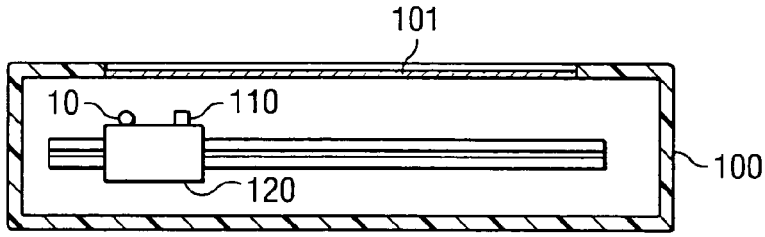
FIG. 1 shows a host system in which a cold cathode lamp may be utilized.
Figure 2:
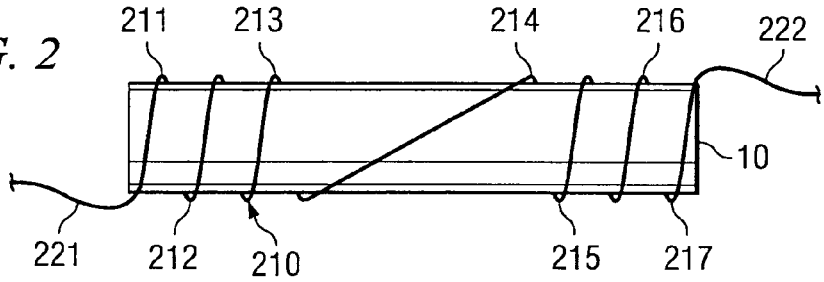
FIGS. 2–4 show cold cathode lamp configurations in which cathode heaters of embodiments of the present invention are present.
Figure 3:
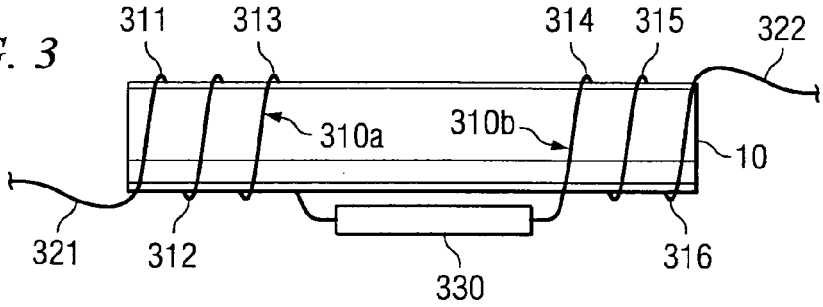
Figure 4:
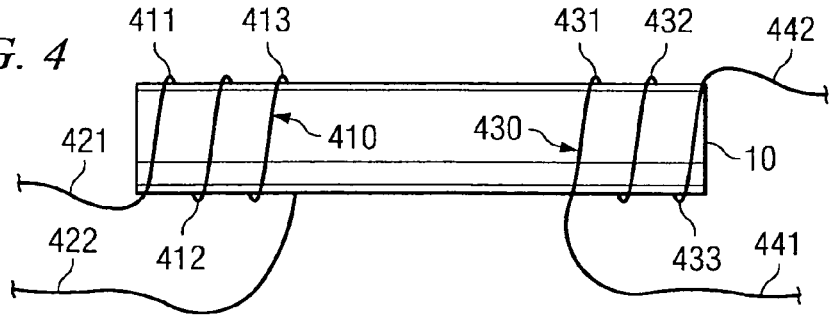

Directing attention to FIGS. 2–4, various embodiments of heater wire configurations providing heat concentration at the cathodes of CCFL 10, such as may be disposed in a scanner or other electronic device, are shown. For example, CCFL 10 may be disposed in an optical scanner, such as optical scanner 100 of FIG. 1. In the embodiment illustrated in FIG. 1, optical scanner 100 includes optical carriage 120 holding CCFL 10 and charge coupled device (CCD) optical array 110 below transparent platen 101. Accordingly, a medium may be placed against platen 101, CCFL 10 energized to illuminate the medium through platen 101, and optical carriage 120 moved to facilitate CCD optical array 110 capturing a complete image of the medium. Of course, rather than optical carriage 120 being moved, the medium may be moved with respect to CCD optical array 110 to facilitate capturing a complete image of the medium.

As discussed in further detail below, FIG. 2 shows a single heater configuration providing significantly reduced heat in the middle of CCFL 10, FIG. 3 shows a single heater configuration providing substantially no heat in the middle of CCFL 10, and FIG. 4 shows a double heater configuration providing substantially no heat in the middle of CCFL 10. The heater configurations of FIGS. 2–4 comprise heater wires disposed on an exterior surface of CCFL 10, such as upon the body of a glass tube incarcerating cathodes thereof and the gas through which electrons emitted from the cathodes pass to stimulate photonic emission. Of course, other configurations may be utilized, such as embedding heater wires within the aforementioned glass tube, if desired.

Figure 5:
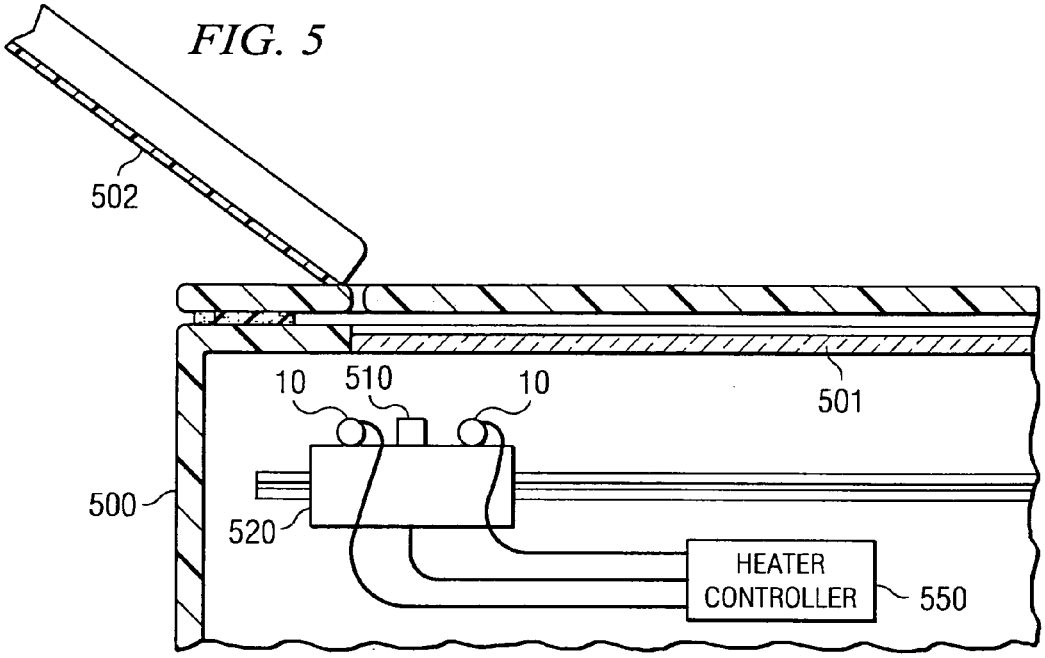
FIGS. 5 and 6 show host systems in which cold cathode lamps of the present invention may be utilized.
Figure 6:
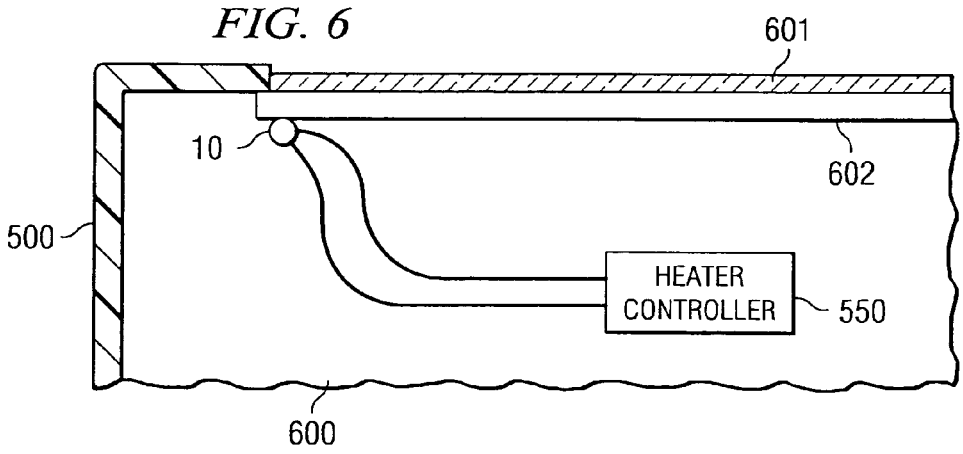

The embodiments of FIGS. 2–4, as well as other embodiments of the present invention, may be utilized in providing rapid start illumination in an optical scanner, such as optical scanner 100 of FIG. 1. Moreover, embodiments of the present invention may be utilized with respect to a variety of host systems, such as a photocopier, facsimile machine, liquid crystal display system, or other devices using a cathode. For example, any embodiment of CCFL 10 of FIGS. 2–4 may be disposed in system 500 of FIG. 5, such as may comprise a photocopier, facsimile machine, or other imaging system. The illustrated embodiment of system 500 includes a plurality of CCFLs 10 disposed upon optical carriage 520, also holding CCD optical array 510, below transparent platen 501. Automatic document feeder 502 may be employed to feed media for illumination by CCFLs 10 and image capture by CCD optical array 510. Similarly, any embodiment of CCFL 10 of FIGS. 2–4 may be disposed in system 600 (FIG. 6), such as may comprise a LCD display system, or other input/output device. The embodiment of system 600 illustrated in FIG. 6 includes CCFL 10 coupled to waveguide 602 disposed below LCD display 601 to distribute light from CCFL 10 substantially evenly across the back of LCD display 601. Also shown in FIGS. 5 and 6 is heater controller 550, such as may include control logic for controlling energization of heater wires of the present invention, as is described in further detail hereinbelow.

Heater wires utilized according to the present invention (e.g., heater wire 210, heater wire portions 310*a* and 310*b*, and heater wires 410 and 430 of FIGS. 2–4) comprise an electronic heating element, such as a mono-filament or stranded configuration of 40–50 AWG (American Wire Gauge) Ni—Cr, e.g., 46 AWG 76% Ni, 22% other. Of course, other materials and composites thereof and other configurations suitable for providing electronic heating elements, as are well known in the art, may be utilized, if desired. For example, embodiments of the present invention may utilize foil traces, ceramic composites, and the like in providing a heater "wire" of the present invention. Thus the term "heater wire" should be broadly construed to include all these embodiments, equivalent embodiments, and other means adapted to heat the cathode. The physical wires shown in FIGS. 2–4 show exemplary embodiments in accordance with various possible embodiments of the present invention.

Leads utilized according to example embodiments of the present invention (e.g., leads 221 and 222, leads 321 and 322, and leads 421, 422, 441, and 442) comprise a low resistance conductor, such as a mono-filament or stranded configuration of 18–20 AWG insulated copper wire. Of course, other materials and composites thereof and other configurations suitable for providing electrical conductors, as are well known in the art, may be utilized, if desired.

FIG. 2 shows a single heater configuration in which heater wire 210 is configured to deliver heat to CCFL 10. Heater wire 210 includes turns 211–217 to deliver heat to CCFL 10.

Turns 211–213 are relatively closely spaced and are disposed at a first end of CCFL 10, corresponding to the location of a first cathode thereof. Similarly, turns 215–217 are relatively closely spaced and are disposed at a second end of CCFL 10, corresponding to the location of a second cathode thereof. Accordingly, the ends of CCFL 10, where the cathodes are disposed, are provided significant contact with heater wire 210, and thus a high concentration of heat therefrom.

Turn 214 is shown bridging the space between turns 213 and 215 and configured such that turns 213–215 are relatively broadly spaced. Accordingly, the middle of CCFL 10, where no cathode is disposed, is provided very little contact with heater wire 210, and thus little heat therefrom.

Concentrating the resulting heat at the areas of the cathodes, as shown in FIG. 2, facilitates desired heating of the cathodes with minimal energy since heat is primarily or only directed to areas where the cathodes exist. Moreover, less total heat may be generated, while still achieving a desired temperature of the cathodes, in the embodiment of FIG. 2 since heat is not directed to the central portion where no cathodes exist.

Similar to the configuration of FIG. 2 discussed above, FIG. 3 shows a single heater configuration in which heater wire portions 310*a* and 310*b* are configured to deliver heat to CCFL 10. Heater wire portion 310*a* includes turns 311–313 to deliver heat to one portion of CCFL 10 while heater wire portion 310*b* includes turns 314–316 to deliver heat to another portion of CCFL 10.

Turns 311–313 are relatively closely spaced and are disposed at a first end of CCFL 10, corresponding to the location of a first cathode thereof. Similarly, turns 314–316 are relatively closely spaced and are disposed at a second end of CCFL 10, corresponding to the location of a second cathode thereof. Accordingly, the ends of CCFL 10, where the cathodes are disposed, are provided significant contact with heater wire portions 310*a* and 310*b*, and thus a high concentration of heat therefrom.

In the embodiment of FIG. 3, rather than a turn of the heater wire bridging the space between turns 313 and 314 of the two heater wire portions, low resistance conductor 330 is provided therebetween such that turns 313 and 314 are relatively broadly spaced. Low resistance conductor 330, such as may be comprised of a mono-filament or stranded configuration 18–20 AWG insulated or non-insulated copper wire, provides substantially no generation of heat. Accordingly, the middle of CCFL 10, where no cathode is disposed, is provided no contact with heater wire portions 310*a* and 310*b*, and thus substantially no heat therefrom. As with the configuration of FIG. 2, concentrating the resulting heat at the areas of the cathodes, as shown in FIG. 3, facilitates desired heating of the cathodes with less energy used and less total heat generated.

FIG. 4 shows a double heater configuration providing substantially no heat in the middle of CCFL 10. Heater wire 410 includes turns 411–413 to deliver heat to one area of CCFL 10 and heater wire 430 includes turns 431–433 to deliver heat to another area of CCFL 10.

Turns 411–413 are relatively closely spaced and are disposed at a first end of CCFL 10, corresponding to the location of a first cathode thereof. Similarly, turns 431–433 are relatively closely spaced and are disposed at a second end of CCFL 10, corresponding to the location of a second cathode thereof. Accordingly, the ends of CCFL 10, where the cathodes are disposed, are provided significant contact with heater wires 410 and 430, and thus a high concentration of heat therefrom.

In the embodiment of FIG. 4, turns 413 and 431 are relatively broadly spaced with no heater wire or conductor bridging the space between heater wires 410 and 430. Accordingly, the middle of CCFL 10, where no cathode is disposed, is provided no contact with heater wires 410 and 430, and thus substantially no heat therefrom.

As with the configurations of FIGS. 2 and 3, concentrating the resulting heat at the areas of the cathodes, as shown in FIG. 4, facilitates desired heating of the cathodes with less energy used and less total heat generated. However, although perhaps providing improved energy/heat efficiency over the embodiment of FIG. 2, and perhaps improved light transmission characteristics (e.g., no shadowing associated with heater wire and/or conductors across the middle of CCFL 10), the embodiment of FIG. 4 provides an implementation in which an increased number of heater wire leads (leads 421, 422, 441, and 442) are utilized as compared to the embodiments of FIGS. 2 and 3 (leads 221 and 222 and leads 321 and 322, respectively).

The particular number of turns utilized with respect to the heater wires and/or conductors illustrated in the embodiments of FIGS. 2–4 are exemplary and are not illustrative of any limitation of the present invention. Accordingly, embodiments of the present invention may implement fewer or more turns in a configuration as represented by any of FIGS. 2–4.

Likewise, the spacing of the turns in the middle section of CCFL 10 in the embodiments of FIGS. 2 and 3 is not limited to that illustrated. However, in the embodiment of FIG. 2 providing as few turns of heater wire 210 as is possible reduces the amount of unnecessary heat generation and its associated energy consumption. Embodiments of the single heater configuration of FIG. 2 may implement no turns in the middle section of CCFL 10, such as illustrated with respect to conductor 330 of FIG. 3, if desired. However, for manufacturing and production reasons, embodiments of the present invention, whether utilizing heater wire or a conductor in the middle section of CCFL 10, employ one or more turns in the middle section of CCFL 10. A turn in the middle section facilitates securing the material of the cathode heater securely to the lamp and/or simplifies manufacturing, as will be better understood from the discussion of a preferred embodiment manufacturing technique described hereinbelow.

Turns of either heater wire or conductor across the middle of CCFL 10 to bridge the gap between heater portions disposed in juxtaposition with cathodes of the lamp may undesirably interfere with the optical characteristics of the lamp in particular situations. For example, turns of heater wire and/or conductor may create shadowing associated with their material's opacity. Although such shadowing associated with the turns disposed at the ends of CCFL 10 may be easily addressed by employing a lamp of sufficient length that its ends are not optically relevant, the middle portion of CCFL 10 may be optically relevant in many configurations. Accordingly, embodiments may employ a plurality of CCFLs 10, such as shown in system 500 of FIG. 5, wherein any shadows associated with such heater wires or conductors of the lamps will be substantially uncorrelated. In such a configuration, illumination from one such lamp may be relied upon to fill shadows associated with illumination from another such lamp, and vice versa. Moreover, the dimensions of heater wires that may be utilized in particular embodiments of the present invention will be sufficiently small so as to render such shadowing optically unimportant in many situations. However, where shadowing is a factor, configurations in which no turns are included in the middle of the lamp, such as illustrated in FIGS. 3 and 4, may be more desirable.

It is desirable to maintain the relatively close spacing of turns disposed in juxtaposition with cathodes to be heated according to some embodiments of the present invention. Accordingly, embodiments of the present invention are provided using a manufacturing technique which affixes heater wires to a host surface along the length thereof, such as shown and described in the above referenced patent application entitled "Attachment Method For Lamp Heater Wire". A preferred technique for securing heater wires, or portions thereof, to the lamp comprises using an adhesive along the length thereof which is activated by the heater wire itself.

For example, heater wires utilized according to the present invention may be coated with a heat activated adhesive. The coated heater wire may be wrapped around a lamp or other device to receive the benefit of a heater of the present invention and the turns adjusted to provide spacing as desired (e.g., relatively close spacing in proximity to cathodes to be heated and relatively broad spacing in other areas). Thereafter, the heater wire may be brought to a temperature sufficient to cause activation of the adhesive, and therefore adhesion of the heater wire in its desired configuration.

According to embodiments of the invention, the activation temperature of the adhesive is above the operational temperature or temperatures of the heater formed thereby, thus providing a substantially permanent heater configuration after application of an activation temperature. Additionally or alternatively, the adhesive utilized may be formulated to activate a single time with the application of heat, again providing a substantially permanent heater configuration after application of an activation temperature.

In operation, energization of cathode heaters, such as those of FIGS. 2–4 above, may be controlled by circuitry (e.g., heater controller 550) coupled to leads thereof to control the flow of current through the heater wires. For example, according to one embodiment, a heater controller may provide current to heater wires of the present invention at all times a host system, e.g., scanner, is powered-up or is not in a sleep or energy save state. Alternatively, a heater controller may provide current to heater wires of the present invention when user activity is detected, e.g., a scan is commenced, a host system cover is opened, media is placed into a host system, and/or the like, and the current may be continued for a time thereafter to accommodate subsequent use in a same user session. As another example of a heater control paradigm useful according to the present invention, a heater controller may provide current to heater wires of the present invention when a lamp heated thereby is energized. Even in a configuration where heater wires of the present invention are not energized until the lamp itself is energized, warm-up time is reduced (e.g., cut by as much as half or two thirds) as the heater wires provide a direct source of heat concentrated at the cathode locations.

Heater controllers utilized according to embodiments of the present invention may be adapted to implement a variety of heater wire energization patterns, such as to improve lamp start times and/or conserve energy. For example, a heater controller utilized according to embodiments of the present invention may provide increased current initially, to more quickly reach a desired cathode temperature upon lamp start-up, and thereafter decrease the provided current to maintain a cathode operating temperature without excessive use of energy. According to one embodiment, although maintaining a heater wire temperature of approximately 130° F. during continuous cathode heating operation, a heater wire temperature of approximately 175° may initially be reached for a period of time determined to bring cathodes heated thereby to a desired operating temperature from a "cold" start in a few seconds.

What is claimed is:

1. A system for providing a thermally optimized cold cathode heater, said system comprising:

a heater wire disposed in a plurality of turns, wherein turns of said plurality of turns are closely spaced to concentrate heat in an area of a host cathode device corresponding to a cold cathode position, and wherein turns of said plurality of turns are disposed to minimize introduction of heat in an area of said host cathode device not corresponding to said cold cathode position;

wherein said closely spaced turns of said plurality of turns comprise a first set of more than one turn corresponding to a first cathode of said host cathode device and a second set of more than one turn corresponding to a second cathode of said host cathode device; and wherein a low resistance conductor couples said first set of more than one turn to said second set of more than one turn.

2. The system of claim 1, wherein a turn of said plurality of turns comprises a turn coupling said first set of more than one turn to said second set of more than one turn, wherein said turn coupling said first and second sets of turns is less closely spaced than said closely spaced turns of said first and second sets of turns.

3. The system of claim 1, wherein said host cathode device comprises a cold cathode lamp.

4. A system comprising:

a cold cathode heater having a heater wire disposed in a plurality of turns, wherein turns of said plurality of turns are more closely spaced in a portion of said cold cathode heater corresponding to a cold cathode position and less closely spaced in a portion of said cold cathode heater that does not correspond to said cold cathode position;

wherein said plurality of turns comprises a first set of more than one turn and a second set of more than one turn; and wherein a portion of the heater wire coupling said first set of more than one turn and said second set of more than one turn does not provide heat output.

5. The system of claim 4, wherein a turn of said first set is less closely spaced from a turn of said second set than are turns of said first set of more than one turn.

6. The system of claim 4, wherein said plurality of turns are concentrated at first and second ends of said cold cathode heater.

7. The system of claim 4, wherein said plurality of turns are more concentrated at ends of said cold cathode heater than at a middle of said cold cathode heater.

8. The system of claim 4, wherein said plurality of turns incarcerate a cold cathode lamp having a cathode at each end thereof said cold cathode comprising at least one of said cathodes at an end of said cold cathode lamp.

9. A method for providing heat to a cold cathode, said method comprising:

wrapping a device having said cold cathode with a heater wire;

varying spacing of the heater wire around the device to concentrate heat in an area of said device corresponding to said cold cathode and to minimize heat in an area of said device not corresponding to said code cathode;

coupling the heater wire to a controller; and coupling a closely spaced plurality of turns with another closely spaced plurality of turns with a low resistance conductor.

10. The method of claim 9, further comprising:

controlling energization of said heater wire to heat said cold cathode throughout an operational state of a host system including said device; varying heating along the device, wherein variations of heating correspond to different concentrations of heating wire on said device.

11. The method of claim 9, further comprising:

controlling energization of said heater wire to heat said cold cathode when user activity is detected with respect to a host system including said device.

12. The method of claim 9, wherein varying spacing comprises providing different spacing between adjacent heater wire along said device.

13. The method of claim 12, wherein varying spacing further comprises providing a first concentration of heater wire at an end of the device and a second concentration of heating wire in a middle of the device, wherein the first concentration is greater than the second concentration.

14. The method of claim 9, wherein said fixedly attaching said heater wire comprises:

energizing said heater wire to activate an adhesive thereon.

15. The method of claim 9, further comprising:

coupling said closely spaced plurality of turns with another closely spaced plurality of turns with a less closely spaced turn.

16. The method of claim 9, wherein said device comprises a cold cathode lamp.

* * * * *

UNITED STATES PATENT AND TRADEMARK OFFICE

CERTIFICATE OF CORRECTION

PATENT NO. : 7,009,329 B2
APPLICATION NO. : 10/644722
DATED : March 7, 2006
INVENTOR(S) : William R. Haas et al.

It is certified that error appears in the above-identified patent and that said Letters Patent is hereby corrected as shown below:

In column 1, line 43, delete “warned” and insert -- warmed --, therefor.

In column 3, line 44, after “22%” insert -- Cr, and 2% --.

In column 8, line 6, in Claim 8, after “thereof” insert -- , --.

Signed and Sealed this

Twelfth Day of May, 2009

JOHN DOLL
*Acting Director of the United States Patent and Trademark Office*